US007643000B2

(12) United States Patent
Cho

(10) Patent No.: US 7,643,000 B2
(45) Date of Patent: Jan. 5, 2010

(54) OUTPUT BUFFER AND POWER SWITCH FOR A LIQUID CRYSTAL DISPLAY AND METHOD OF DRIVING THEREOF

(75) Inventor: Seong Ho Cho, Seoul (KR)

(73) Assignee: LG Display Co. Ltd., Seoul (KR)

( * ) Notice: Subject to any disclaimer, the term of this patent is extended or adjusted under 35 U.S.C. 154(b) by 605 days.

(21) Appl. No.: 11/437,910

(22) Filed: May 22, 2006

(65) Prior Publication Data

US 2007/0001978 A1 Jan. 4, 2007

(30) Foreign Application Priority Data

Jun. 30, 2005 (KR) ..... 10-2005-0058126

(51) Int. Cl.
*G09G 3/36* (2006.01)

(52) U.S. Cl. ..... 345/98; 345/211; 345/212

(58) Field of Classification Search ..... 345/98, 345/211–214

See application file for complete search history.

(56) References Cited

U.S. PATENT DOCUMENTS

| | | | | |
|---|---|---|---|---|
| 6,201,523 | B1 * | 3/2001 | Akiyama et al. | 345/96 |
| 7,136,039 | B2 * | 11/2006 | Bu et al. | 345/98 |
| 7,286,125 | B2 * | 10/2007 | Morita | 345/211 |
| 7,518,603 | B2 * | 4/2009 | Yamamoto et al. | 345/211 |
| 2004/0041773 | A1 * | 3/2004 | Takeda et al. | 345/98 |
| 2004/0145583 | A1 * | 7/2004 | Morita | 345/211 |
| 2005/0088395 | A1 * | 4/2005 | Chung | 345/98 |

* cited by examiner

*Primary Examiner*—Amare Mengistu
*Assistant Examiner*—Gene W Lee
(74) *Attorney, Agent, or Firm*—Morgan Lewis & Bockius LLP

(57) ABSTRACT

A liquid crystal display device having an output buffer connected to at least one of a common electrode and a data line of a liquid crystal display panel as well as a power switch for driving the output buffer by dividing into an on-period and an off-period.

11 Claims, 5 Drawing Sheets

OUTPUT BUFFER AND POWER SWITCH FOR A LIQUID CRYSTAL DISPLAY AND METHOD OF DRIVING THEREOF

The present invention claims the benefit of Korean Patent Application No. P2005-0058126, filed in Korea on Jun. 30, 2005, which is hereby incorporated by reference.

BACKGROUND OF THE INVENTION

1. Field of the Invention

The present invention relates to a liquid crystal display device, and more particularly to a mobile liquid crystal display device that reduces power consumption and a driving method thereof.

2. Discussion of the Related Art

A liquid crystal display device controls the light transmittance of a liquid crystal having dielectric anisotropy by use of an electric field to display a picture. To this end, the liquid crystal display device includes a liquid crystal display panel having a pixel matrix and a drive circuit for driving the liquid crystal display panel. Specifically, the liquid crystal display device, as shown in FIG. 1, includes a liquid crystal display panel 10 having a pixel matrix, a gate driver 12 for driving the gate lines GL of the liquid crystal display panel 10, a data driver 14 for driving the data lines DL of the liquid crystal display panel 10, and a timing controller 16 for controlling the gate driver 12 and the data driver 14.

The liquid crystal display panel 10 includes a pixel matrix composed of pixels formed at each intersection of the gate lines GL and the data lines DL. Each pixel includes a liquid crystal cell Clc which controls the light transmittance in accordance with a data signal, and a thin film transistor TFT for driving the liquid crystal cell Clc. The thin film transistor TFT receives and maintains a data signal from the data line DL in the liquid crystal cell Clc in response to a scan signal of the gate line GL. The liquid crystal Clc changes the arrangement state of the liquid crystal in accordance with the data signal to control the light transmittance, thereby realizing a gray level.

The gate driver 12 sequentially supplies the scan signal to the gate lines GL in response to the control signal from the timing controller 16. The data driver 14 converts a digital data signal from the timing controller 16 into an analog data signal to supply to the data lines DL. The timing controller 16 supplies a control signal to control the gate driver 12 and the data driver 14 and supplies the digital data to the data driver 14.

Small liquid crystal display devices with the above-described features are mainly used in mobile applications. However, power consumption must be reduced for such applications. To this end, a mobile liquid crystal display device, as shown in FIG. 2, uses a line inversion method that inverts the polarity of the liquid crystal cell for each horizontal line.

As shown in FIG. 3, the line inversion method inverts the polarity of the common voltage $V_{com}$ for each horizontal synchronization period 1H when the gate line is driven by the gate signal $V_{gate}$, thereby enabling to reduce the data voltage $V_{data}$. However, even using the line inversion method, the power consumption is rather high due to the frequency of the common voltage $V_{com}$. Thus, a method which can reduce the power consumption is needed.

SUMMARY OF THE INVENTION

Accordingly, the present invention is directed toward a mobile liquid crystal display and a method for driving the same that substantially obviates one or more of the problems due to the limitations and disadvantages of the related art.

An object of the present invention is to provide a mobile liquid crystal display device and a method of driving the same that is adapted to reduce power consumption.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the mobile liquid crystal display device includes an output buffer connected to at least one of a common electrode and a data line of a liquid crystal display panel as well as a power switch section to drive the output buffer into an on-period and an off-period.

In another aspect, the driving method of a liquid crystal display device includes the steps of supplying an output signal by driving an output buffer connected to at least one of a common electrode and a data line of a liquid crystal display panel in a first period as well as turning-off the output buffer in a second period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
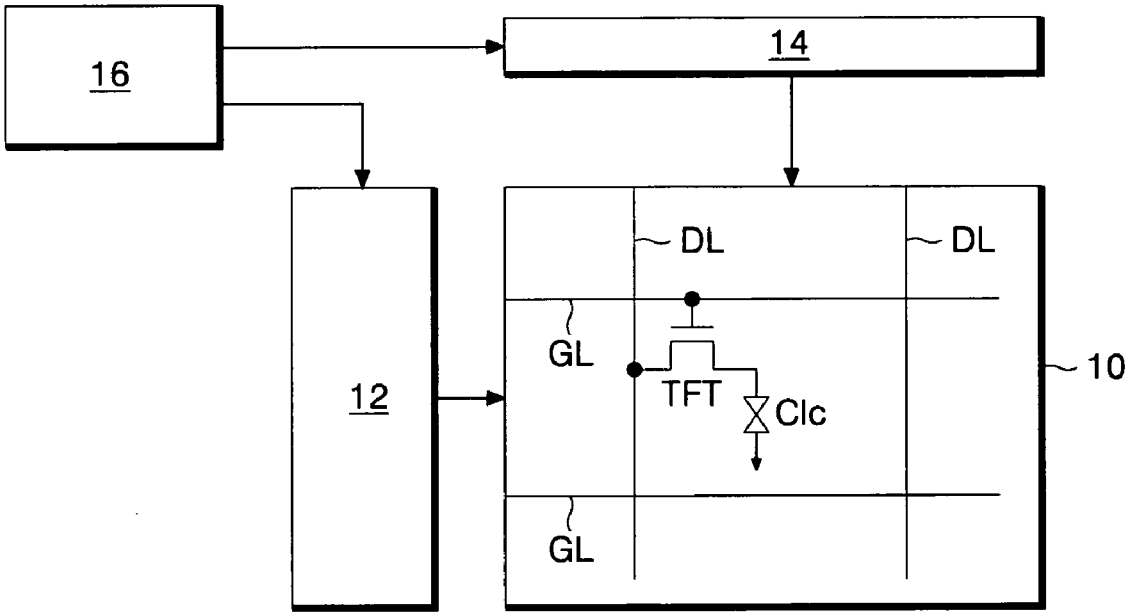
FIG. 1 RELATED ART
FIG. 1 is a block diagram illustrating a liquid crystal display device of the related art.
Figure 2:
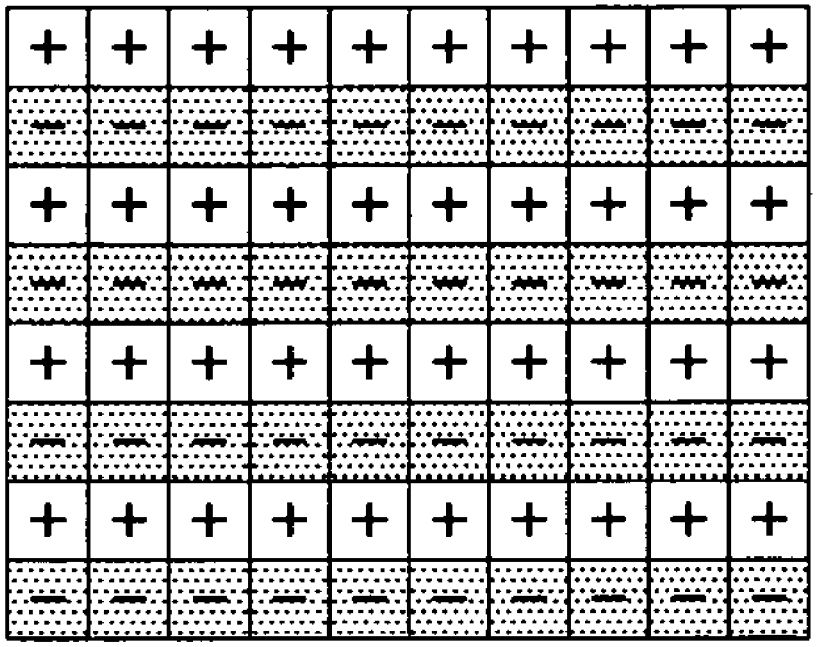
FIG. 2 RELATED ART
FIG. 2 is a diagram illustrating polarities of the liquid crystal cell driven in a line inversion method of the related art.
Figure 3:
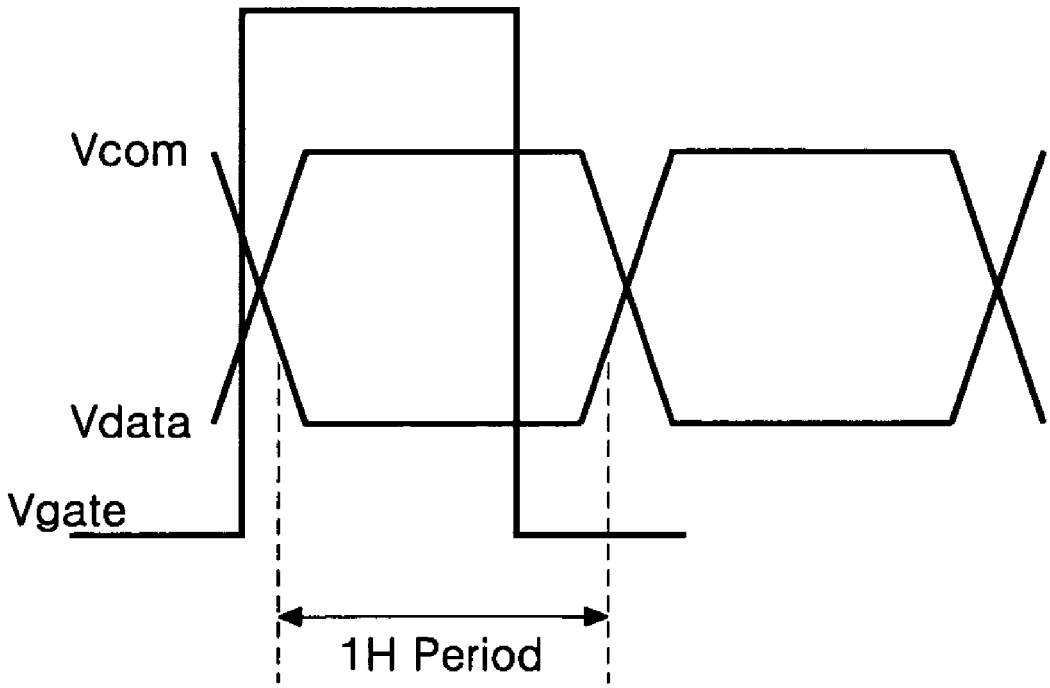
FIG. 3 RELATED ART
FIG. 3 is a drive waveform diagram of a gate line and a common electrode of the related art during line inversion driving.
Figure 4:
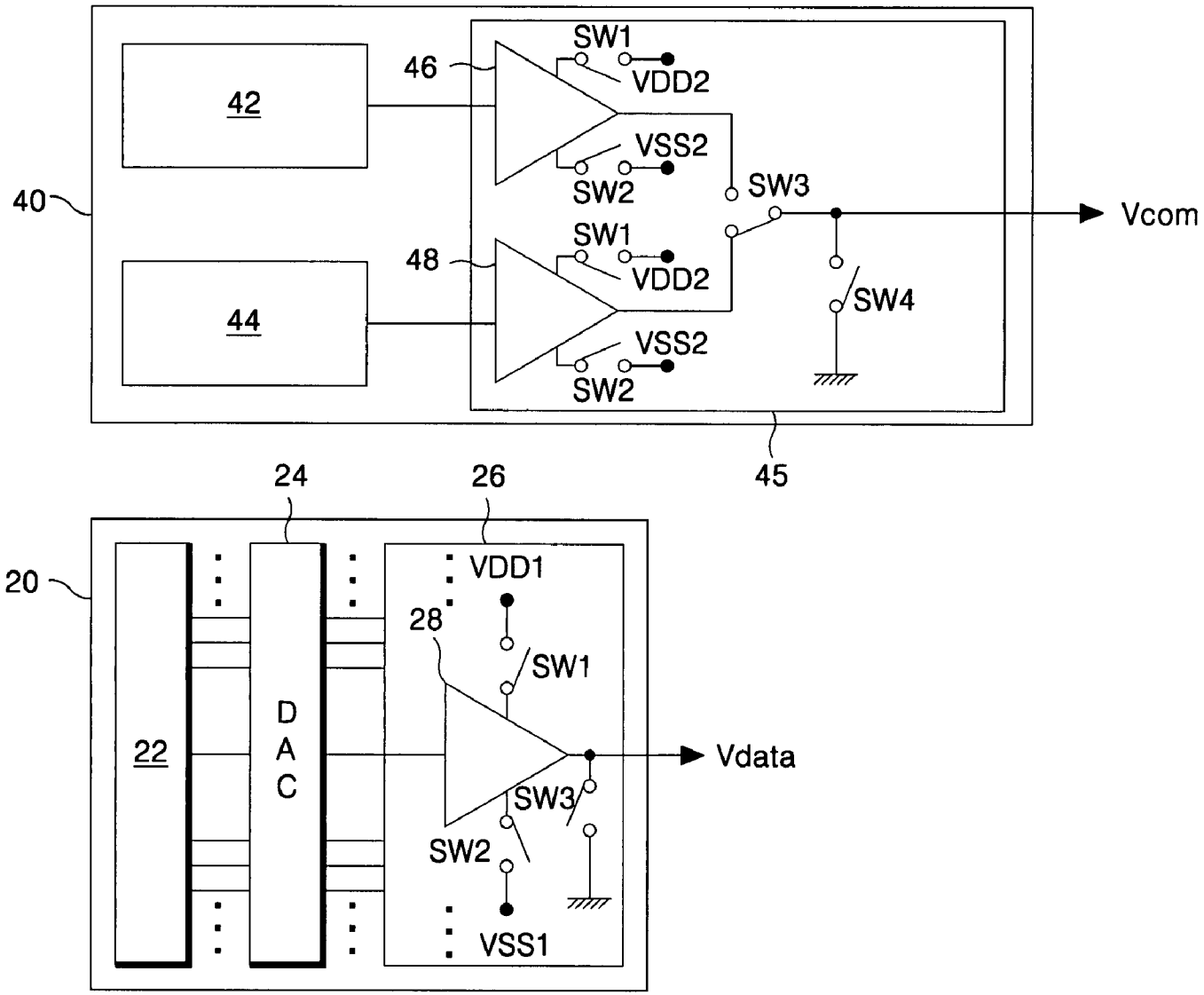
FIG. 4 is a circuit diagram illustrating a common voltage generator and a data driver of a liquid crystal display device according to an exemplary embodiment of the present invention.
Figure 5:
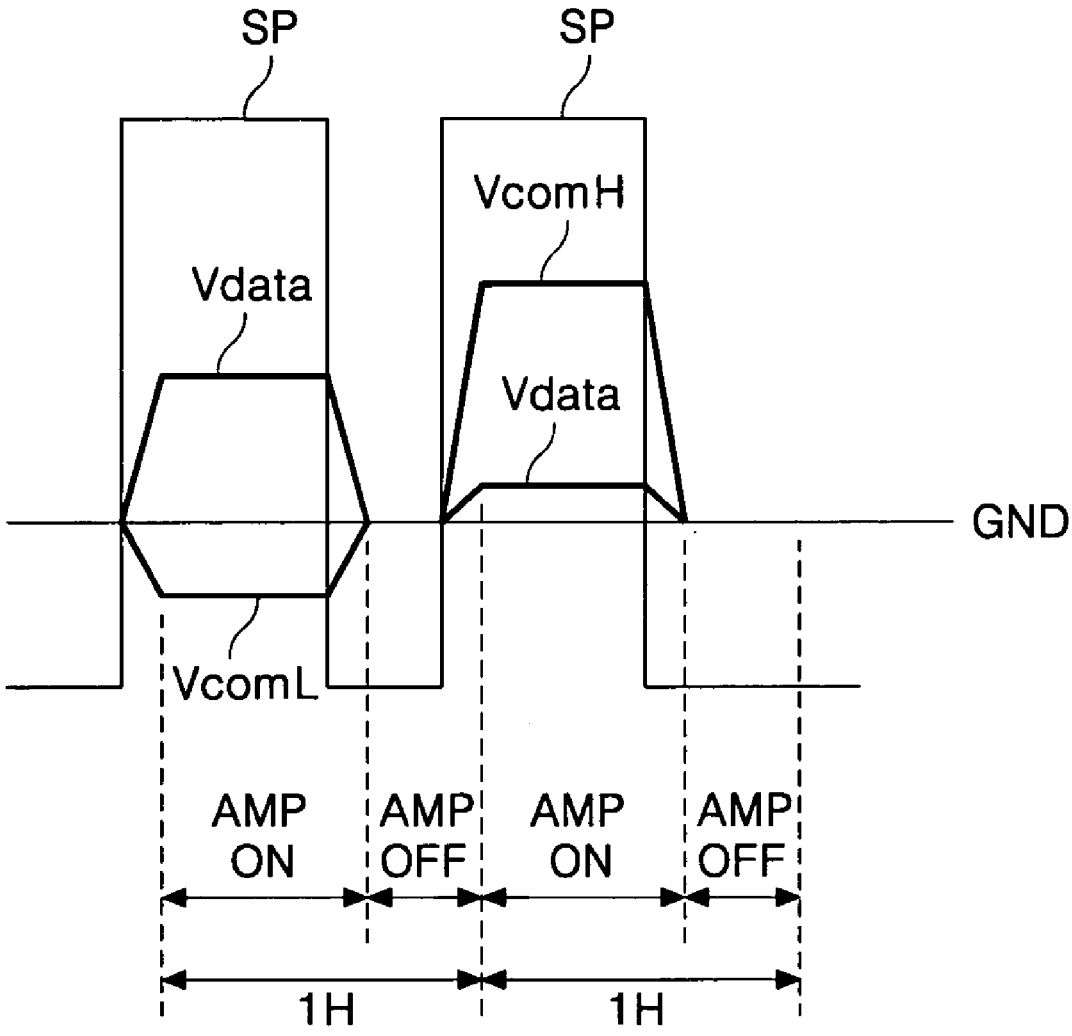
FIG. 5 is an exemplary drive waveform diagram of the common voltage generator and the data driver shown in FIG. 4.

FIG. 4 illustrates a data driver 20 and a common voltage generator 40 of a drive circuit (not shown) in a liquid crystal display device according to an exemplary embodiment of the present invention. FIG. 5 illustrates an exemplary drive waveform of the drive circuit shown in FIG. 4.

As shown in FIG. 4, the data driver 20 supplies a data signal $V_{data}$ to a data line of a liquid crystal display panel and the common voltage generator 40 supplies a high common voltage $V_{com}$ to a common electrode of the liquid crystal display panel. The data driver 20 converts digital data into analog data signals in accordance with a supply signal and a control signal input from the outside and supplies the converted analog data signals to the data line of the liquid crystal panel. To this end, the data driver 20 includes a logic circuit part 22, a digital-analog converter (hereinafter, referred to as "DAC") 24, and an output buffer part 26.

The logic circuit part 22 sequentially samples the digital data input from the outside to a latch (not shown), and supplies the latched digital data to the DAC 24. The DAC 24 converts the digital data received from the logic circuit part 22 into the analog data signals using a gamma voltage and supplies the converted analog data signals to the output buffer part 26.

The output buffer part 26 buffers the analog data signals from the DAC 24 and supplies the buffered analog data signals to the data lines of the liquid crystal display panel. Specifically, each one of a plurality of output buffers 28 included in the output buffer part 26 is connected to a data line. The output buffer 28 charges the data signal $V_{data}$ in the data line close to the input signal from the DAC 24 using a charging current going through a first switch SW1 connected to a first high potential voltage VDD1 line and a discharging current going through a second switch SW2 connected to a first low potential voltage VSS1 line. The output buffer part 26 further includes a third switch SW3 connected between a ground voltage GND line and an output line of the output buffer 28.

The output buffer part 26 divides one horizontal period 1H into an on-period and an off-period of the output buffer 28 using the first and second switches SW1 and SW2. When the output buffer 28 is turned on through the first and second switches SW1 and SW2, the output buffer part 26 buffers the data signal $V_{data}$ in the data line using the charging and discharging currents. The output buffer part 26 turns off the output buffer 28 through the first and second switches SW1 and SW2 when the data signal $V_{data}$ is buffered. At the same time, the third switch SW3 is turned on to ground the data line. Accordingly, the current consumption of the output buffer 28 is decreased and the swing width of the line-inverted data signal $V_{data}$ as shown in FIG. 5 is reduced. Thus, power consumption is reduced.

Switches SW1, SW2 and SW3 are controlled by a gate enable signal GOE, which determines a period of supplying a scan signal SP in a gate driver, as shown in FIG. 5. Generally, a mobile liquid crystal display device has low resolution so that one horizontal synchronization period 1H of about 100 μs is sufficient. Thus, the data signal $V_{data}$ can be buffered in the on-period of the output buffer 28, as shown in FIG. 5.

The common voltage generator 40, as shown in FIG. 4, includes a first common voltage generator 42 for generating a high common voltage $V_{comH}$, a second common voltage generator 44 for generating a low common voltage $V_{comL}$, and an output buffer part 45, which alternately buffers the high common voltage $V_{comH}$ and the low common voltage $V_{comL}$ from the first and second common voltage generators 42 and 44 supplied to the common electrode of the liquid crystal display panel.

The output buffer part 45 includes first and second output buffers 46 and 48 respectively connected to the output lines of the first and second common voltage generators 42 and 44. The output buffer part 45 further includes a third switch SW3 for switching the output of the first and second output buffers 46 and 48 and a fourth switch SW4 for grounding the common electrode.

The first output buffer 46 charges the common voltage $V_{com}$ in the common electrode close to the high gate voltage $V_{comH}$ from the first common voltage generator 42 through the third switch SW3 using the charging current going through the first switch SW1 connected to the second high potential voltage VDD2 line and a discharging current going through the second switch SW2 to the second low potential voltage VSS2 line. The second high potential voltage VDD2 may or may not equal the first high potential voltage VDD1. Similarly, the second low potential voltage VSS2 may or may not equal the first low potential voltage VSS1. The second output buffer 48 charges the common voltage $V_{com}$ in the common electrode close to the low gate voltage $C_{comL}$ from the second common voltage generator 44 through the third switch SW3 using the charging current going through the first switch SW1 from the second high potential voltage VDD2 line and a discharging current going through the second switch SW2 to the second low potential voltage VSS2 line. The third switch SW3 alternately supplies the high common voltage $V_{comH}$ of the first output buffer 46 and the low common voltage $C_{comL}$ of the second output buffer 48 to the common electrode in response to a polarity control signal for the line inversion.

As shown in FIG. 5, the output buffer part 45, divides one horizontal period 1H into the on-period and off-period of the first and second output buffers 46 and 48 through the first and second switches SW1 and SW2. The output buffer part 45 buffers the corresponding common voltage $V_{com}$ through the third switch SW3 in the common electrode using the charging and discharging current when the first and second output buffers 46 and 48 are turned on through the first and second switches SW1 and SW2. The first and second switches SW1 and SW2 are controlled by the gate enable signal GOE as described for the data driver 20. The output buffer part 45 turns off the output buffer 28 through the first and second switches SW1 and SW2 when the common voltage $V_{com}$ is buffered. At the same time, the fourth switch SW4 is turned on to ground the common electrode. Accordingly, the current consumption of the first and second output buffers 46 and 48 is reduced, and the swing width of the line inversion common voltage $V_{com}$ is reduced as shown in FIG. 5, thereby reducing the power consumption.

In case of driving the data line and the common electrode by an inversion method of two lines or more where the off-period of the horizontal synchronization period has the same polarity as the next horizontal synchronization period, only the first and second output buffers 46 and 48 of the common voltage generator 40 and the output buffer 28 of the data driver 20 are turned off by the first and second switches SW1 and SW2 to make the data line and the common electrode float. During this time, the third switch SW3 of the data driver 20 and the fourth switch SW4 of the common voltage generator 40 are turned off.

In the off-period of the horizontal synchronization period where the polarity is opposite to that of the next horizontal synchronization period, the output buffers 28, 46 and 48 are all turned off by the first and second switches SW1 and SW2, and the third switch SW3 of the data driver 20 and the fourth switch SW4 of the common voltage generator 40 are turned on to ground the data line and the common electrode. Accordingly, even in the inversion method of two lines or more, the swing widths of the common voltage $V_{com}$ and the data signal $V_{data}$, which is inverted for each two lines or more, are reduced to reduce power consumption.

As described above, the mobile liquid crystal display device and the driving method thereof according to the exemplary embodiment of the present invention divides one horizontal synchronization period into an on-period and an off-period of the output buffer. The data signal and the common voltage are output only in the on-period of the output buffer, and the data line and the common electrode are grounded in the off-period. Accordingly, the current consumption of the output buffer and the swing widths of the common voltage and the data signal are reduced, thereby reducing power consumption.

Further, the mobile liquid crystal display device and the driving method thereof according to the exemplary embodiment of the present invention make the data line and the common electrode float during the output buffer off-period in the horizontal synchronization period that has the same polarity as the next one. During the output buffer off-period in the horizontal synchronization period that has a different polarity from the next one, the data line and the common electrode are grounded. Accordingly, even in the inversion method of two lines or more, the swing widths of the common voltage and data signal and the current consumption of the output buffer are reduced, thereby reducing power consumption.

It will be apparent to those skilled in the art that various modifications and variations can be made in the mobile liquid crystal display and method for driving the same of the present invention without departing from the spirit or scope of the invention. Thus, it is intended that the present invention cover the modifications and variations of this invention provided they come within the scope of the appended claims and their equivalents.

I claim:

1. A liquid crystal display device, comprising:

a data driver for supplying a data signal to a data line of a liquid crystal display panel; and a common voltage generator for supplying a high common voltage or a low common voltage to a common electrode of the liquid crystal display panel, wherein the data driver includes a logic circuit part, a digital-analog converter and an output buffer part, wherein the output buffer part of the data driver includes a plurality of output buffers connected to the data line, each output buffer of the data driver including a first switch connected to a first high potential voltage line, a second switch connected to a first low potential voltage line and a third switch connected between a ground voltage line and an output line of the output buffer, wherein the output buffer part of the data driver divides one horizontal period into an on-period and an off-period of the plurality of output buffers using the first and second switches, wherein the common voltage generator includes a first common voltage generator for generating the high common voltage, a second common voltage generator for generating the low common voltage and an output buffer part, wherein the output buffer part of the common voltage generator includes a first and second output buffers respectively connected to output lines of the first and second common voltage generators, each output buffer of the common voltage generator including a first switch connected to a second high potential voltage line, and a second switch connected to a second low potential voltage line, the output buffer part of the common voltage generator further including a third switch for switching the output of the first and second output buffers and a fourth switch for grounding the common electrode, wherein the output buffer part of the common voltage generator divides one horizontal period into the on-period and off-period of the first and second output buffers through the first and second switches.

2. The liquid crystal display device according to claim 1, wherein the third switch of the buffer part of the data driver is a ground switch to ground the output line of the output buffer part, wherein the fourth switch of the output buffer part of the common voltage generator is a ground switch to ground the output line of the output buffer part.

3. The liquid crystal display device according to claim 1, wherein the third switch of the output buffer part of the data driver grounds the output line of the output buffer in the off-period, wherein the fourth switch of the output buffer part of the common voltage generator grounds the output line of the output buffer in the off-period.

4. The liquid crystal display device according to claim 3, wherein the third switch of the output buffer part of the data driver and the fourth switch of the output buffer part of the common voltage generator are controlled by a gate enable signal which determines a period when a scan pulse is supplied to a gate line of the liquid crystal display panel.

5. The liquid crystal display device according to claim 2, wherein the third switch of the output buffer part of the data driver grounds the output line of the output buffer part of the data driver in the off-period of the horizontal synchronization period when supplying an output signal having a polarity that is opposite to that of the next horizontal synchronization period, wherein the fourth switch of the output buffer part of the common voltage generator grounds the output line of the output buffer part of the common voltage generator in the off-period of the horizontal synchronization period when supplying an output signal having a polarity that is opposite to that of the next horizontal synchronization period.

6. The liquid crystal display device according to claim 2, wherein the third switch of the output buffer part of the data driver makes the output line of the output buffer part of the data driver float in the off-period of the horizontal synchronization period when supplying an output signal having a polarity that is the same as that of the next horizontal synchronization period, wherein the fourth switch of the output buffer part of the common voltage generator makes the output line of the output buffer part of the common voltage generator float in the off-period of the horizontal synchronization period when supplying an output signal having a polarity that is the same as that of the next horizontal synchronization period.

7. A driving method of a liquid crystal display device including a data driver for supplying a data signal to a data line of a liquid crystal display panel and having a logic circuit part, a digital-analog converter and an output buffer part and a common voltage generator for supplying a high common voltage or a low common voltage to a common electrode of the liquid crystal display panel and having a first common voltage generator for generating the high common voltage, a second common voltage generator for generating the low common voltage and an output buffer part, comprising the steps of:

supplying the data signal to the data line of the liquid crystal display panel in a first period;

supplying the high common voltage or the low common voltage to the common electrode of the liquid crystal display panel in the first period; and turning-off the output buffer part of the data driver and the output buffer part of the common voltage generator, wherein the output buffer part of the data driver includes a plurality of output buffers connected to the data line, each output buffer of the data driver including a first switch connected to a first high potential voltage line, a second switch connected to a first low potential voltage line and a third switch connected between a ground voltage line and an output line of the output buffer, wherein the output buffer part of the data driver divides one horizontal period into the first period and a second period of the plurality of output buffers using the first and second switches, wherein the output buffer part of the common voltage generator includes a first and second output buffers respectively connected to an output lines of the first and second common voltage generators, each output buffer of the common voltage generator including a first switch connected to a second high potential voltage line, and a second switch connected to a second low potential voltage line the output buffer part of the common voltage generator further including a third switch for switching the output of the first and second output buffers and a fourth switch for grounding the common electrode, wherein the output buffer part of the common voltage generator divides one horizontal period into the first period and the second period of the first and second output buffers through the first and second switches.

8. The driving method according to claim 7, wherein the third switch of the output buffer part of the data driver grounds the output line of the output buffer in the second period, wherein the fourth switch of the output buffer part of the common voltage generator grounds the output line of the output buffer in the second period.

9. The driving method according to claim 7, wherein the first and second periods are divided by a gate enable signal which determines a period when a scan pulse is supplied to a gate line of the liquid crystal display panel.

10. The driving method according to claim 8, wherein the output line of the output buffer part of the data driver is grounded only in the second period of a horizontal synchronization period when supplying an output signal of which the polarity is contrary to that of the next horizontal synchronization period, wherein the output line of output buffer part of the common voltage generator is grounded only in the second period of a horizontal synchronization period when supplying an output signal of which the polarity is contrary to that of the next horizontal synchronization period.

11. The driving method according to claim 7, wherein the output line of the output buffer part of the data driver is floated only in the second period of a horizontal synchronization period when supplying an output signal of which the polarity is the same as that of the next horizontal synchronization period, wherein the output line of the output buffer part of the common voltage generator is floated only in the second period of a horizontal synchronization period when supplying an output signal of which the polarity is the same as that of the next horizontal synchronization period.

* * * * *